United States Patent [19]

Gillenwater

[11] Patent Number: 5,069,004

[45] Date of Patent: Dec. 3, 1991

[54] ABRASIVE ENGRAVING PROCESS

[76] Inventor: R. Lee Gillenwater, 6250 NE 198 St., Seattle, Wash. 98155

[21] Appl. No.: 485,467

[22] Filed: Feb. 27, 1990

[51] Int. Cl.[5] ..... B24C 1/04

[52] U.S. Cl. ..... 51/310; 51/262 R; 51/319; 118/504; 118/505

[58] Field of Search ..... 51/310, 311, 312, 262; 118/504, 505, 301; 427/282

[56] References Cited

U.S. PATENT DOCUMENTS

| | | | |
|---|---|---|---|
| 3,067,718 | 12/1962 | Kraft | 118/58 |
| 3,085,368 | 4/1963 | Oostland | 51/310 |
| 3,170,810 | 2/1965 | Kagan | 118/505 |
| 3,280,715 | 10/1966 | Corl | 269/8 |
| 4,528,906 | 7/1985 | Hasagawa | 101/127.1 |

FOREIGN PATENT DOCUMENTS

| | | | |
|---|---|---|---|
| 2409160 | 7/1979 | France | 118/505 |
| 0002320 | 1/1985 | Japan | 427/282 |
| 0051568 | 3/1985 | Japan | 118/505 |
| 0004669 | 1/1986 | Japan | 51/312 |
| 0057278 | 3/1988 | Japan | 118/504 |
| 2218656 | 11/1989 | United Kingdom | 51/310 |

*Primary Examiner*—Robert A. Rose

*Attorney, Agent, or Firm*—Patrick Michael Dwyer

[57] ABSTRACT

An abrasive engraving process employing the steps of applying a topical coating 30 of magnetically interactive material to a work substrate 10, applying a stencil 40 cut from a magnetic material to the surface, covering stencil 40 with an identically cut stencil cut from an abrasion resistant material such as polyurethane, placing the work and its stencils above a strongly attractive magnetic field from magnet 60, and abrasively etching the exposed areas of the surface of substrate 10.

14 Claims, 1 Drawing Sheet

ABRASIVE ENGRAVING PROCESS

TECHNICAL FIELD

This invention relates to the field of engraving and etching processes, and particularly to the field of etching and engraving by means of abrasively removing portions of one surface of a work substrate. More particularly, the invention relates to an abrasive engraving process which employs a magnetically interactive stenciling system to define the nonetched areas of the surface.

BACKGROUND OF THE INVENTION

Works of commercial and fine art are often engraved or etched upon some relatively hard surfaced material such as wood, glass, tile, slate, other ceramic, or even sheets of various kinds of metal. It is known to make abrasive transfers by means of stencils onto these work substrates or media by using one or more jets of some abrasive material in compressed air. Commonly a fine sandblasting grade of sand is used to make the abrasive etching or engraving.

Many stenciling systems have been devised to mask, or partially mask, the work substrate or medium upon which the etching or engraving is to be transferred. Typically this involves the cutting of a stencil from some softer material which is relatively more abrasion resistant than the work substrate on which the engraving is to be transferred. One problem with some known stencil and engraving methods is that the stencil is very soon worn out by the abrasive process after only a few engraving and etching transfers have been made. This typically requires that a number of stencils be cut, if many transfers are expected to be made. This both increases the cost of the transfer process for multiple copies, and tends to limit the process to the use of abrasive transfers for art work which does not have a great deal of detail. It is surmised that the reason for this is that cutting multiple copies of stencils with much fine detail is simply too time consuming a process to be commercially feasible.

One approach to this problem is presented by a polyurethane sandblasting stencil manufactured by the 3M Company, and further described in U.S. Pat. No. 3,916,050. However, the 3M product is adhesive backed and is suitable only for one time use. This stencil does not meet the need for a durable reusable stencil in an abrasive etching system.

Methods of attaching other stencils to the work substrate or work medium, such as double sided tapes of various kinds, are unsatisfactory, both because they allow abrasive fuzzing of edges and details by virtue of the fact that the abrasive carrying medium, typically compressed air, forces the abrasive under the untaped portions of the stencil, and also because of problems in getting the adhesive of the tape off of the work medium after the abrasive engraving transfer has been completed.

What is needed then is a stenciling process for abrasive engraving transfer of fine and commercial art work containing a large proportion of detail. This stenciling process should be at once capable of being held closely to the surface of the work medium to avoid abrasive fuzzing of detail, and at the same time be highly resistant to the abrasive process itself so that it may be reused, and thereby justify the time expenditure of cutting a stencil with so much fine detail.

DISCLOSURE OF THE INVENTION

Accordingly it is an object of the invention to provide an abrasive engraving process which employs a stencil which can contain fine detail, and which is itself highly resistant to the abrasive engraving process.

It is a further object of the invention to provide an abrasive engraving process as above with stencils that are capable of being held so closely to the surface of the work substrate that abrasive fuzzing of edges and of fine detail is virtually eliminated.

It is another object of the invention to provide an abrasive engraving process as above which makes as much use as possible of inexpensive and readily available materials.

It is a still further object of the invention to provide an abrasive engraving process which is readily susceptible to use in an automated engraving system so as to maximize the quality and quantity of commercial output while minimizing the cost.

These and other objects of the invention which will become apparent in this specification are accomplished by the means and in the manner herein set forth. One of the principle steps in the process is the creation of a stencil, with or without fine artistic detail, from a commonly available magnetic material, such as the rubberized material from which commercial removable magnetic automobile door signs are made. This sign material may be obtained relatively inexpensively in large quantities and may be readily cut with stencil cutting tools to create a relatively abrasion resistant stencil. In order to further protect this magnetic stencil from abrasion, preferred embodiments of the process will also employ a stencil cut to the identical pattern as the magnetic stencil, but cut from the 3M polyurethane sand blast stencil material which is disclosed and described in U.S. Pat. No. 3,916,050. This particular material need not be employed, however, as other highly resilient, and therefore abrasion resistant, materials will also occur to those skilled in the art and will also be suitable for stencil cutting use. This upper stencil will act as the first interceptor of abrasive particles to be masked from etching or engraving the work substrate, and so prolong the life of the relatively more expensive, and typically somewhat more difficult to cut, magnetic stencil material. It is anticipated that the upper stencil will wear out before the lower magnetic stencil and thereby reduce the cost and effort of maintaining the particular magnetic stencil for the engraving transfer of a particular art work.

Another principle step in the process is the magnetic means by which the magnetic stencil material is held closely to the work substrate. The essence of this step is that the magnetic stencil is held to the surface of the work substrate by magnetic attraction which holds the magnetic stencil to the work surface. This magnetic attraction can be accomplished in either one or both of two additional steps. One preferred step is to apply to the work surface prior to the abrasive blasting process a coating of a magnetically interactive substance. ("Magnetically interactive" as used in this specification means any material which can respond in a magnetic field to be either attracted to or repelled from a source of the magnetic field.) The thickness of this coating will depend upon the degree of magnetic interactivity of the coating material itself; however, in preferred embodiments a coating of approximately 5 mils in thickness is used.

The magnetically interactive coating is preferably comprised of particles of some ferromagnetic substance and some conventional coating medium in which the ferromagnetic substance may be suspended while the coating medium is liquid, and which will, after a suitable drying time, dry into a preferably permanent coating on the work surface. Powdered or atomized iron filings have been found to work well in any of a number of commercially available lacquer products. The filings are mixed and suspended in the liquid lacquer and the liquid lacquer is then applied, preferably by spraying, to the surface of the work substrate on which the art work is to be transferred by engraving or etching. When the coating is dry, the magnetic stencil is applied, with or without the additional upper protective stencil. The work substrate and stencil(s) are then exposed to the abrasive blasting process, which is preferably sand blast quality sand in a compressed air medium of delivery sprayed across the surface of the stencil and exposed work substrate. The topical magnetically interactive coating is of course abraded away by the abrasive sand, and so is so much of the work substrate as is deemed desireable to achieve the transfer of the art work.

Depending upon the concentration of ferromagnetic material in the coating medium, varying degrees of magnetic attraction between the magnetic stencil and the coated work surface can be achieved. It has been found that the greatest possible attraction is required only when using higher air pressures for delivery of the abrasive medium. Lower pressures of delivery of abrasive medium can be used with correspondingly lesser degrees of magnetic attraction and interaction between the magnetic stencil and the topical coating.

In the other of the two additional steps referred to above, it is sometimes desireable to employ a separate source of strong magnetic attractive force positioned beneath the work substrate material, either instead of, or in addition to the topical coating and process described above. Most of the commercially used work substrates such as wood, various ceramics, marble, slate, glass, mica, and metal sheets are thin enough so that a strongly attractive magnetic force positioned beneath the work substrate will nonetheless have considerable magnetic effect on magnetically interactive materials immediately above the surface of the work substrate.

A suitable strong magnetic force may be had from either a permanent magnet or preferably an electromagnet. In this step of the process, when the work substrate with its magnetic stencil applied is positioned above the magnet, the force with which the stencil is held to the surface of the work substrate, with or without the topical magnetically interactive coating, is such as to permit sandblasting at typically higher sandblasting air pressure deliveries without loss of fine detail in the art work transfer. Preferably the topical coating will be used in conjunction with the electromagnetic force. This combination will ensure the highest quality of artistic transfer for most work substrates, and most commercial purposes. The preferred use of the topical coating has the additional advantage of providing a flat naturally colored surface on the work substrate which remains in all of the unengraved, or unetched, portion of the work substrate. Where the unetched portions of the work substrate are to be colored, the color coating is applied on top of the magnetically interactive coating before etching.

Where, for commercial or aesthetic reasons, a coating on the work substrate is neither desireable nor feasible, or where the work substrate itself is a magnetic substance, some particulate substance, or a porous metal, it is anticipated that the topical magnetically interactive coating will not be used. One typical aesthetic example would be where an engraving or etching transfer is to be made onto a polished hardwood surface, where it is desireable to maintain the appearance of the polished hardwood in the interstices between the etched portions of the hardwood. In all of these circumstances the magnetic stencil on top of the work substrate positioned over the magnet, or electromagnet, will provide adequate magnetic attractive force to hold the magnetic stencil to the work surface for the transfer of the fine details of the art work to the work substrate.

Preferred embodiments of the process will employ an electromagnet with an interuptable power supply which is positioned beneath a relatively magnetically transparent conveyor belt on which are then positioned pieces of work substrate with associated magnetic stencils. As the work with its magnetic stencil is positioned over the electromagnet, which is switched off during movement of the conveyor, the conveyor is stopped, the electromagnet is switched on, and the abrasive process is applied to the surface of the work substrate. The magnet is then turned off, the conveyor is moved to remove the finished engraved work and to position a new substrate/stencil combination atop the magnet.

The bonding and attachment of the upper, or shield, stencil to the magnetic stencil may be enhanced by coating the upper surface of the magnetic stencil with a vinyl film, and then coating the lower surface of the shield stencil with an adhesive film.

It has also been found that use of the separate magnetic process permits a corresponding use of a magnetically less interactive coating on the work substrate surface for a given air pressure of the sandblasting delivery system. Thus the use of the electromagnet can decrease the cost of the coating process, even when the coating process itself is not eliminated.

BEST MODE FOR CARRYING OUT THE INVENTION

Figure 1:
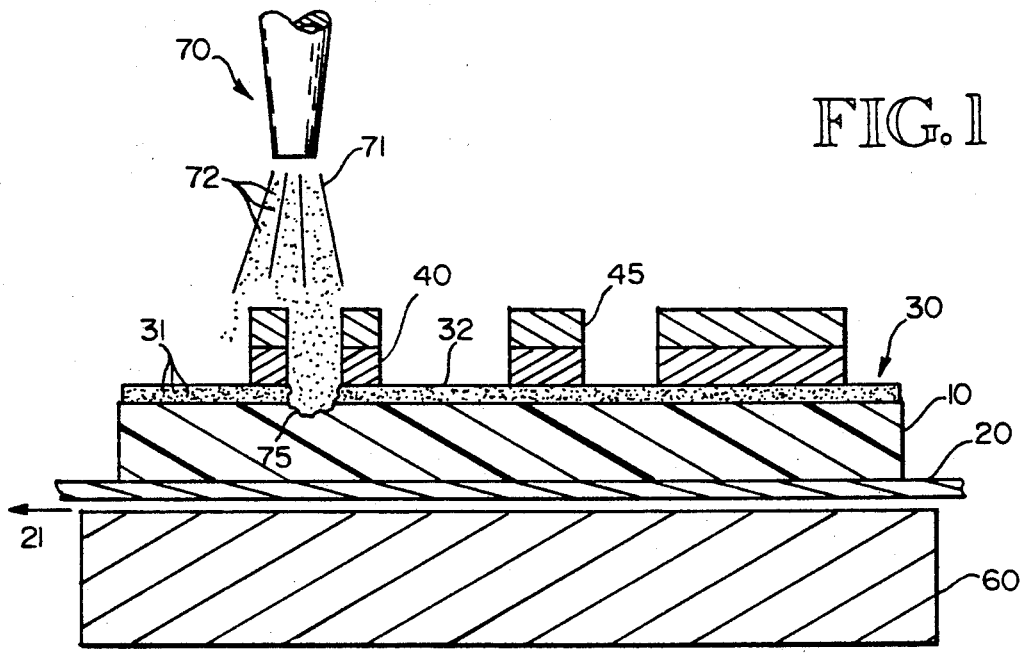
FIG. 1 is a cross section of the work substrate and stencils illustrated in FIG. 2 taken along lines A—A of FIG. 2, and including schematic illustration of an abrasive delivery system, a conveyor belt, and a magnet.
Figure 2:
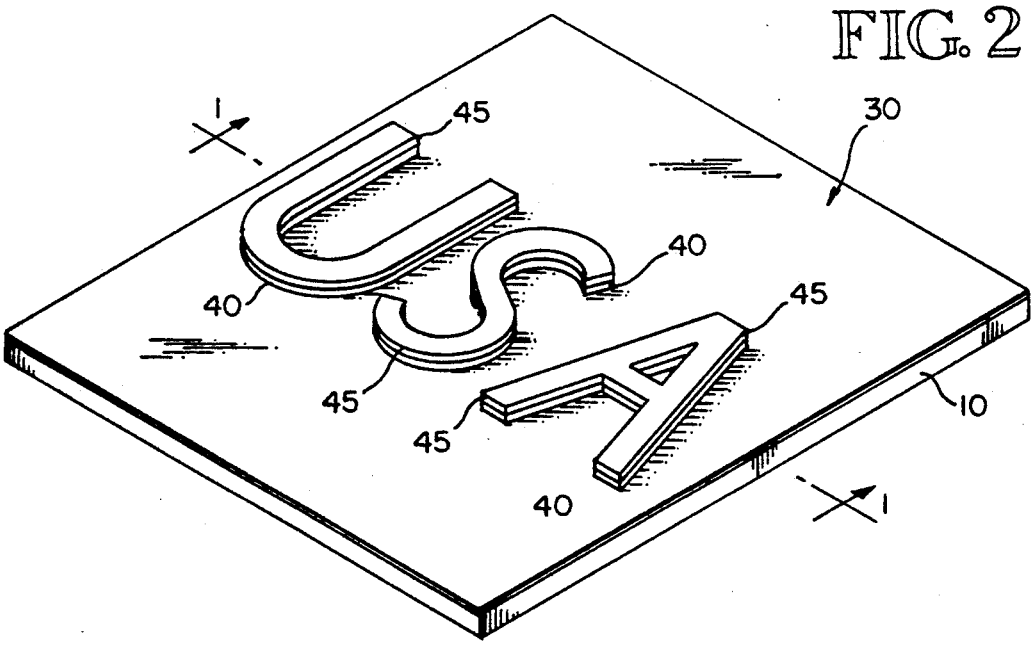
FIG. 2 is a perspective view of a coated work substrate shown with stencils in position for abrasive engraving.

Referring now to the drawings wherein like numbers indicate like parts, the invention is further described. FIGS. 1 and 2 illustrate positioning of a work substrate 10 with a topical coating 30 of magnetically interactive material 31 and magnetic stencil 40 covered with shield stencil 45 positioned on conveyor belt 20 and delivered to a position above magnet 60 along direction of conveyor movement 21.

In preferred embodiments of the abrasive engraving process of the invention, magnet 60 is an electromagnet which is switched off until work substrate 10 is positioned directly above on conveyor 20. Magnet 60 is then switched on to create a strong magnetic field which magnetically interacts with topical coating 30 and magnetic mat 40 to hold magnetic mat 40 firmly to coating 30 on work substrate 10. Abrasive delivery system 70 is then activated to deliver a high velocity stream of air 71 with abrasive particles 72 suspended therein for impact upon coating 30 and work substrate 10 to produce etching 75.

The invention may best be characterized as one or more methods, and may also be characterized as an apparatus. A preferred embodiment of an apparatus of the invention will comprise a work substrate 10 which may be any etchable or engravable material, but it is contemplated that commonly employed materials will be polished hardwoods, other woods, various ceramic materials such as tile, marble, slate, masonry, glass, mica, and various metal sheeting materials. Disposed atop work substrate 10 will lie magnetic stencil 40 cut from a mat of magnetically interactive material such as preferably the material from which removable magnetic automobile door signs are made. However, other magnetically interactive materials which are also suitable for stencil cutting will occur to those skilled in the art, such as for instance specially manufactured sheets of polyurethane rubber in which are either suspended or coated sufficient ferromagnetic material to render the sheet material magnetically interactive. It is contemplated that sheeting material, now known or later developed in the art, which contains a proportion of magnetized iron or other ferromagnet materials will come to serve as well as or better than the presently preferred magnetic door sign mat material. Other possible substitutions will include any commonly known, or later developed, stencil sheet material, above or beneath of which is applied a magnetic coating of some coating medium combined with magnetized ferromagnetic materials.

In the apparatus of the invention, magnetic stencil 40 is held to substrate 10 by magnetic attraction. Where substrate 10 is itself a ferromagnetic material such as sheet steel, it is contemplated that no additional components are required to effect a strong enough magnet bonding between magnetic stencil 40 and substrate 10 in order to perform the abrasive engraving at moderate to high air pressure delivery pressures while at the same time preserving transfer of artistic detail in the etchings 75 on substrate 10.

Where the substrate does not itself posses magnetically interactive or magnetic properties, then one or both of two additional apparatus components are employed. The preferred component to effect magnet attraction of magnet stencil 40 to substrate 10 is a topical coating 30 comprised of magnetically interactive material 31 and a coating medium 32. Powdered, sometimes referred to as atomized, iron is the preferred magnetically interactive material, and the preferred coating medium is any commercially available standard grade of clear lacquer. Other magnetically interactive ferromagnetic materials which may or may not be powdered may also be employed in topical coating 30.

In addition it is contemplated that topical coating 30 may be deposited on work substrate 10 by methods other than the creation of a liquid mix of some lacquer like medium 32 and iron particles 31. For instance it is contemplated that by technologies now known or later developed a magnetically interactive topical coating 30 may be laid down upon a work substrate 10 by electrostatic deposition and then appropriately magnetized. It is also contemplated that a topical coating 30 consisting of some sheet material of magnetically interactive ferromagnetic material, such as very thin steel sheets, may be laid down upon, and bonded to, substrate 10 by some thermal or mechanical process, or by means of adhesives now known or later developed. What is essential to the invention is not the particular process by which the magnetically interactive topical coating 30 is applied to substrate 10; but rather the placement on the work substrate 10 of a topical magnetic coating of any description, and by any means.

Presently, the preferred coating 30 is comprised of a quantity of atomized iron 31 mixed with a common clear lacquer product. Other substitutes for the lacquer product are contemplated as well, including polyurethane coatings of all descriptions, shellacs, enamels, and other types of paint and coating products. Preferred proportions of atomized iron to lacquer are in the range of 2 to 10 pounds of powdered iron per gallon of lacquer. Lower concentrations of atomized iron in the lacquer are preferred for ease of spray application and for reduced cost of coatings. However in some applications, the lower concentrations of powdered iron to lacquer will not result in sufficient magnetic interaction with the magnetic stencil to hold all of the stencil portions against the coating 30 on work substrate 10 to ensure against fuzzing or blurring of fine detail in the resultant etching or engraving. This will usually occur at high air pressures of abrasive delivery, such as pressures above 40 p.s.i. However, relatively low concentrations of atomized iron in the lacquer will serve well for low pressure abrasive delivery systems and also where, in addition to the magnetically interactive topical coating 30, there is also used a magnet 60, as will be further described below.

Where a magnet 60 is not going to be used, and/or where it is contemplated that medium to high air pressures (over 40 p.s.i.) will be employed in the abrasive delivery system, concentrations of powdered iron to lacquer in the range of 4 to 10 pounds of iron per gallon of lacquer are preferred. For concentrations of iron per gallon of lacquer as discussed above, the preferred coating thickness will be 5 mils. Greater thicknesses of coating may result in uneven coatings which will require sanding to a smooth finish, or else result in uneven and inexact transfer of fine detail, and of course thicker coatings will also be more expensive. Thinner coatings may not provide sufficient magnetic interaction with magnetic stencil 40, particularly where it is contemplated that no magnet 60 will be employed as part of the process. As will be appreciated by those skilled in the art, some work substrates 10 may require one or more precoatings of some commonly available sealing material prior to the deposition of the magnetically interactive coating 30.

As an alternative to, or in addition to, coating 30 a magnet 60 may be employed in the abrasive engraving process of the invention. Where a coating 30 on substrate 10 is employed together with magnet 60, magnet 60 will increase the attractive force with which magnetic stencil 40 is held to coating 30 and substrate 10, thereby typically increasing the amount of fine detail possible in the transfer of the art work by the engraving process. In addition however, magnet 60 may be used with magnetic stencil 40 without coating 30. As indicated above, many substrates will not be compatible with such a topical coating, and some substrates, for appearance and aesthetic reasons would be defaced by the application of such a coating. Under any of the above circumstances, or merely where it is desired to have magnetic stencil 40 held to substrate 10 with the greatest possible force, a magnet 60 will be employed beneath substrate 10. As mentioned above, magnet 60 may be either a large permanent magnet, or a series of magnets, or may be one or more electromagnets. Electromagnets are preferred because they can be readily switched on and off so that a conveyor 20 may be used to move work pieces 10 onto and off of the magnetically active site. Typically electromagnet 60 or a plurality of electromagnets 60 will be disposed beneath conveyor belt 20 upon some suitable framework (not shown) the nature and structure of which will readily occur to those skilled in the art. Preferably, a material is selected for conveyor belt 20 which is as transparent to magnetic fields as possible, while at the same time being as resistant to abrasion by the abrasive particles of the abrasive delivery system as possible.

Any commonly available abrasive delivery system 70 may be employed, but a system where the air pressure of delivery may be selectably varied is preferred. Either hand held nozzles or stationarily mounted nozzles may be employed, as well as both singular and multiple nozzle configurations. What is important about an abrasive delivery system 70 is that the delivery pressure selected remains relatively constant throughout the abrasive engraving process and that the abrasive particles 72 are directed from the delivery system nozzle generally perpendicularly to work piece 10. These kinds of considerations for the abrasive delivery system are well understood in the art. Preferred abrasive particles 72 are commonly available sandblasting grade sand, however other abrasive particles may be substituted.

Optionally, particularly where it is desired to prolong the life of magnetic stencil 40 through repeated cycles of the abrasive engraving process so as to create multiple work piece engravings from a single stencil, shield stencil 45 is employed. Shield stencil 45 is cut with the indentical artistic pattern of magnetic stencil 40 and aligned and disposed directly on top of magnetic stencil 40. It may be held in place upon magnetic stencil 40 with any of a number of common stencil aligned and adhesive methods. It is also contemplated that shield stencil 45 may itself be magnetically interactive, such as described above in the specification, including being coated or made with magnetically interactive material, being made of steel sheeting or attached to steel sheeting, or being made of a magnetic material. Such a magnetic shield stencil 45 would then magnetically attach to magnetic stencil 40. It has been found that a vinyl coating, either already present on the top of magnetic stencil 40, or added to it, together with a common stencil adhesive on the bottom surface of shield stencil 45 serves well to temporarily join shield stencil 45 to magnetic stencil 40. However, shield stencils without a vinyl coating may also be employed.

Shield stencil 45 takes most, if not all, of the abrasive force of abrasive particle 72 and is relatively resistant to abrasive effect from particle 72. However, when shield stencil eventually wears thin, or wears out, it can be peeled off of magnetic stencil 40 and replaced with a new shield stencil 45. A preferred material for shield stencil 45 is 3M polyurethane sandblast stencil mat as disclosed and described in U.S. Pat. No. 3,916,050. However, other resilient sheet material, whether or not made of polyurethane, will also serve effectively in this reusable stencil engraving process.

INDUSTRIAL APPLICABILITY

This invention will find use in the etching and engraving industry, particularly in the commercial art industry where numerous copies of an art work are to be etched upon some medium such as wood, glass, tile, metal, or the like. The invention is commercially superior to existing commercial art engraving methods because it employs a reusable system whereby hundreds of engravings may be made from one stencil set, and the invention also employs a stenciling system which cooperates so closely with the work substrate or medium upon which the engraving is to placed, that extremely fine detail is possible. Most of the components of the system will be inexpensive and readily available throughout the world.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications with the legitimate and valid scope of the appended claims, appropriately interpreted in accordance with the doctrine of equivalents.

I claim:

1. A method of abrasively engraving a work substrate, the method comprising the steps of: a) applying a topical magnetically interactive coating to an upper surface of said substrate; b) disposing atop said surface a stencil cut from a magnetic material; and c) exposing said stencil and said surface to abrasive etching.

2. The method of claim 1 further comprising the step of disposing over said magnetic stencil an identically cut stencil of some abrasion resistant material prior to abrasive etching of step (c) in claim 1 above.

3. The method of claim 1 further comprising the step after step (b) of claim 1 above of placing said coated substrate with said magnetic stencil in a strong magnetic field having a polarity set to urge said magnetic stencil toward said substrate.

4. The method of claim 1 further comprising additional steps between step (b) and step (c) of claim 1 above, the steps comprising: disposing over said magnetic stencil an identically cut stencil of some abrasion resistant material and placing said coated substrate with said magnetic stencil in a strong magnetic field having a polarity set to urge said magnetic stencil toward said substrate.

5. The method of claim 1 wherein said magnetically interactive coating is comprised of atomized iron suspended in a coating medium, and the concentration of said atomized iron by weight to volume of medium is 4 to 10 pounds iron per gallon of medium, and wherein said coating is applied to a dry thickness of at least 5 mils.

6. The method of claim 4 further comprising the step of carrying said coated substrate with said magnetic stencil and said abrasion resistant stencil over said magnetic field by means of a conveyor system.

7. The method of claim 5 wherein the ratio of iron by weight to said coating medium is 2 to 4 pounds iron per gallon of medium.

8. The method of claim 4 wherein said strong magnetic field is an electromagnetic field.

9. An apparatus for abrasively engraving a work substrate comprising: a) a topical coating of magnetically interactive material disposed on an upper surface of said substrate; and b) a stencil cut from a magnetic material disposed upon said coating.

10. The apparatus of claim 9 further comprising an abrasion resistant identically cut stencil disposed upon said magnetic stencil.

11. The apparatus of claim 10 wherein said abrasion resistant stencil material is comprised of a polyurethane sand blast stencil.

12. The apparatus of claim 9 wherein said coating when applied is comprised of a mixture of atomized iron and lacquer in the ratio of 4 to 10 pounds of atomized iron per gallon of lacquer.

13. The apparatus of claim 12 wherein said coating is applied to a dried thickness of at least 5 mils.

14. The apparatus of claim 9 further comprising a strong electromagnet disposed beneath said substrate.

* * * * *